US009573290B2

(12) United States Patent
Reis

(10) Patent No.: US 9,573,290 B2
(45) Date of Patent: Feb. 21, 2017

(54) TRANSPORTING ROLLER FOR ADVANCING WORKPIECES MADE OF WOOD, PLASTIC AND THE LIKE

(75) Inventor: Georg Reis, Wertheim (DE)

(73) Assignee: Michael Weinig AG, Tauberbischofsheim (DE)

( * ) Notice: Subject to any disclaimer, the term of this patent is extended or adjusted under 35 U.S.C. 154(b) by 1065 days.

(21) Appl. No.: 13/806,756

(22) PCT Filed: Jun. 7, 2011

(86) PCT No.: PCT/EP2011/002770
§ 371 (c)(1),
(2), (4) Date: Dec. 22, 2012

(87) PCT Pub. No.: WO2011/160770
PCT Pub. Date: Dec. 29, 2011

(65) Prior Publication Data

US 2013/0098504 A1 Apr. 25, 2013

(30) Foreign Application Priority Data

Jun. 23, 2010 (DE) ..... 10 2010 025 212

(51) Int. Cl.
*B27B 25/02* (2006.01)

(52) U.S. Cl.
CPC ..... *B27B 25/02* (2013.01)

(58) Field of Classification Search
CPC ..... B27B 25/02; B27D 1/005; B65H 72/00; B65H 2404/181
USPC ..... 492/28, 30, 33, 37, 35, 36
See application file for complete search history.

(56) References Cited

U.S. PATENT DOCUMENTS 606,886 A * 7/1898 Buek ..... B27B 25/02 144/174
1,589,595 A * 6/1926 Hitchcock ..... B23B 27/24 226/193
3,788,371 A * 1/1974 Mason ..... B27B 1/00 144/248.7

(Continued)

FOREIGN PATENT DOCUMENTS

CN 2666636 Y 12/2004
CN 201224133 Y 4/2009

(Continued)

*Primary Examiner* — Jason L Vaughan
(74) *Attorney, Agent, or Firm* — Gudrun E. Huckett

(57) ABSTRACT

The transporting roller (1) has teeth (6) arranged in a distributed manner over the circumference. To allow a high advancing force to be achieved with the transporting roller (1) at the same time as an only low pressing force over a long operating time and service life, at least some of the teeth (6) comprise a main tooth (7) and at least one secondary tooth (9), which is arranged at a distance from the main tooth and has a smaller tooth tip radius (r2) than the main tooth (7). With the secondary teeth (9), there is an additional transfer of force exerted on the workpiece (2). The secondary teeth (9) limit the depth of penetration of the main teeth (7). When there is a high pressing pressure, the secondary teeth (9) penetrate partially into the work-piece (2). The main and secondary teeth (7, 9) penetrate only slightly into the work-piece (2), and so only a small amount of material has to be removed to eliminate any markings.

11 Claims, 5 Drawing Sheets

(56) References Cited

U.S. PATENT DOCUMENTS

| | | | | | |
|---|---|---|---|---|---|
| 4,385,650 | A * | 5/1983 | Schmidt | B65G 39/02 | 144/248.5 |
| 4,718,338 | A | 1/1988 | Koba | | |
| 4,721,139 | A * | 1/1988 | Peterson | B27B 25/02 | 144/208.7 |
| 4,783,378 | A * | 11/1988 | Wakui | B21B 1/227 | 428/600 |
| 4,790,360 | A | 12/1988 | Clarke et al. | | |
| 4,978,583 | A * | 12/1990 | Wakui | B21B 1/227 | 219/121.68 |
| 5,234,040 | A * | 8/1993 | Koba | B27D 1/005 | 100/121 |
| 5,797,438 | A * | 8/1998 | Dye | B27B 25/02 | 144/242.1 |
| 5,944,078 | A * | 8/1999 | Lindholm | B27B 25/02 | 144/208.1 |
| 6,170,728 | B1 * | 1/2001 | Zenczak | B65H 5/062 | 226/193 |
| 6,213,177 | B1 * | 4/2001 | Kempe | B27B 25/02 | 144/246.1 |
| 6,253,813 | B1 | 7/2001 | Kube et al. | | |
| 7,640,956 | B2 * | 1/2010 | Arvidsson | B27B 25/02 | 144/246.1 |

FOREIGN PATENT DOCUMENTS

| | | | | |
|---|---|---|---|---|
| CN | 201353813 | Y | 12/2009 | |
| DE | 2032934 | A1 | 12/1971 | |
| DE | 3639938 | A * | 6/1988 | B27B 25/02 |
| EP | 0 273 172 | A1 | 7/1988 | |
| FI | 116370 | B | 11/2005 | |
| WO | 97/04930 | A1 | 2/1997 | |

* cited by examiner

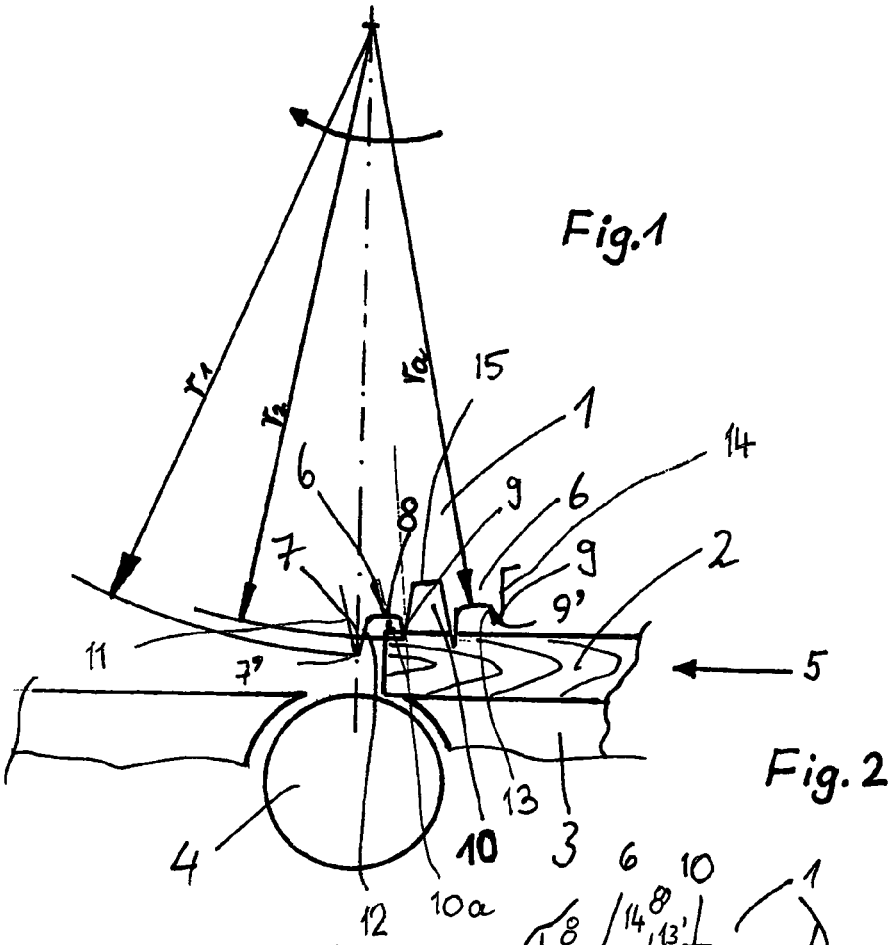
Fig.1
Fig.2
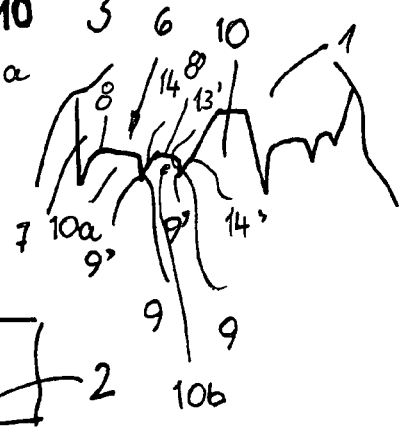
Fig.3
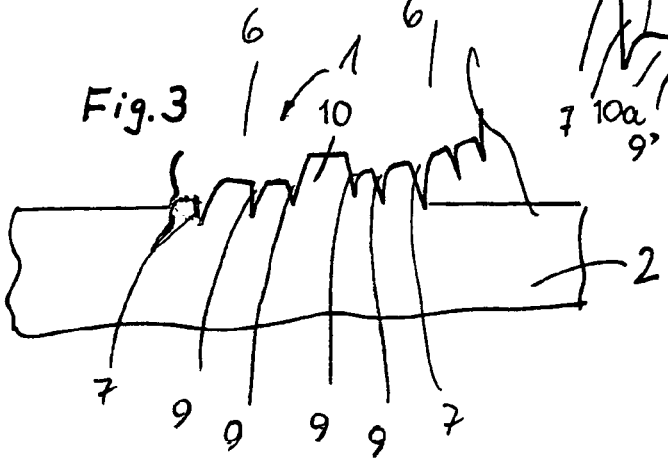

TRANSPORTING ROLLER FOR ADVANCING WORKPIECES MADE OF WOOD, PLASTIC AND THE LIKE

BACKGROUND OF THE INVENTION

The invention concerns a transporting roller for advancing workpieces made of wood, plastic, and the like and provided with teeth arranged in distribution about the circumference.

Such transporting rollers are used, for example, in woodworking machines and serve for transporting the pieces of wood to be machined on a support table in this machine. The transporting rollers are pressed with a roller pressure against the pieces of wood to be transported and are driven in rotation. The teeth engage the topside of the pieces of wood and impart to them an advancing force upon rotation.

In known transporting rollers (EP 0 273 172 B1), the teeth are provided with contact surfaces extending transversely to their flank and limiting the penetration depth of the teeth into the workpiece. The number of teeth that penetrate simultaneously into the workpiece, or contact it, depends on the diameter of the transporting roller and the roller pressure. Due to wear, the pointed teeth however become rounded, do not penetrate as easily into the workpiece, and reduce therefore the advancing action. Accordingly, it is necessary to press the transporting roller with greater force onto the workpieces in order to obtain the same advancing effect. In case of abrasive workpieces or abrasive pieces of wood or a long duration of use, the teeth will wear to such an extent that the force transmission from the transporting roller onto the workpiece is achieved only by the contact surfaces. The effect of the transporting roller is thus greatly reduced and can be compensated only, at least partially, by high roller pressure. Higher roller pressures effect greater friction forces on the surface of the workpieces contacting the support table which counteract the advancing direction and advancing force. The wear of the teeth limits thus the service life and duration of use of the transporting roller.

A further aspect is soiling of the transporting roller by resin deposits or by wood chips or splinters that are produced upon penetration into the workpiece. Strongly soiled transporting rollers also cannot penetrate as far and as easily into the workpiece so that the advancing force is reduced.

It is an object of the invention to configure a transporting roller of the aforementioned kind in such a way that with it a high advancing force is achieved with only minimal roller pressure over an extended duration of use and service life of the transporting roller.

SUMMARY OF THE INVENTION

This object is solved according to the invention for the transporting roller of the aforementioned kind in that at least some of the teeth have a main tooth and at least one auxiliary tooth positioned at a spacing to the main tooth, wherein the auxiliary tooth has a smaller tooth tip radius than the main tooth.

With the auxiliary teeth that have a smaller tooth tip radius than the main teeth, an additional force transmission is exerted onto the workpiece. The auxiliary teeth limit the penetration depth of the main teeth. At high roller pressure, the auxiliary teeth penetrate partially into the workpiece. The main and auxiliary teeth penetrate only minimally into the workpiece so that the elimination of possibly existing markings requires only minimal material removal. Since the auxiliary teeth penetrate less strongly into the workpiece and at reduced roller pressure do not penetrate at all into the workpiece, they are mechanically less strongly loaded, therefore wear less and remain pointed for a longer period of time so that, in case of partially worn main teeth, the auxiliary teeth can more easily penetrate into the workpiece.

The auxiliary teeth can be arranged downstream of the main teeth in the direction of rotation of the transporting roller.

However, it is also possible that the auxiliary teeth in the direction of rotation of the transporting roller are positioned upstream and downstream of the main teeth. In such a case, neighboring teeth are arranged relative to each other such that the auxiliary tooth of one tooth is positioned adjacent to the auxiliary tooth of the neighboring tooth.

The main tooth and the auxiliary tooth of the tooth are advantageously connected to each other by a contact surface. By means of the latter, the main tooth and also the auxiliary tooth are imparted with a thicker area that leads to a high stability of main tooth and auxiliary tooth. Moreover, with this contact surface it is prevented that the teeth will penetrate to deeply into the workpiece to be transported.

The contact surface adjoins transversely a lateral surface of the main tooth and a lateral surface of the auxiliary tooth. The contact surface can be tangentially positioned relative to the circumferential surface of the transporting roller but also at a slant thereto.

A slantedly positioned contact surface has the advantage that wedge surfaces are avoided which ca cause clamping of chips in the chip receiving space of the tooth.

The lateral surfaces of the main tooth and/or of the auxiliary tooth advantageously pass with a rounded portion into the contact surface.

The contact surface can be flat but can also be concavely curved. By means of a rounded configuration of the contact surface, material and resin residues can be prevented. Also, by means of the rounded portions cleaning of the transporting roller with regard to adhering workpiece particles is facilitated.

The area between the main tooth and the auxiliary tooth forms a chip receiving space provided within the tooth. The contact surface forms in this connection the bottom of this chip receiving space.

The contact surface is advantageously provided with a raised portion. By means of the latter, chips positioned within the chip receiving space of the tooth can be reliably prevented from being clamped and are stripped off.

The raised portion has only a minimal height so that, relative to the tips of the main tooth and the auxiliary teeth, it is recessed. As a result of the minimal height, the function of the contact surface is not impaired by the raised portion.

The contact surface is recessed relative to the main tooth and the auxiliary tooth. In this way, it is achieved that in use of the transporting roller first the main tooth, and optionally the auxiliary tooth, contacts the workpiece. With a correspondingly high roller pressure, the contact surface will finally contact the workpiece so that further penetration of the tooth is prevented.

Advantageously, between neighboring teeth a chip receiving space is provided in order to be able to receive possibly produced chips upon advancing of the workpieces.

However, it is also possible to provide no chip receiving space between neighboring teeth.

In order for the chip receiving space to have satisfactory receiving volume, the bottom of the chip receiving space relative to the contact surface is radially recessed.

With regard to the different tasks of the main tooth and the auxiliary tooth, they have dissimilar cross-sections. In regard to providing approximately the same bending and transverse stresses, it is preferred that the main tooth and the auxiliary tooth have the same wedge angle. The latter is smaller than approximately 50 degrees, preferably 40 degrees. Main tooth and auxiliary tooth however may also have different wedge angles wherein then the main tooth preferably has a greater wedge angle than the auxiliary tooth. Main tooth and auxiliary tooth can be embodied to be relatively pointed. As a result of the small wedge angle, the main teeth can engage to a satisfactory degree the workpiece, even for a relatively minimal radially acting roller pressure, in order to engage and transport it safely. Despite the small wedge angle, the main teeth have as a result of the contact surface a high strength.

The auxiliary teeth also have a high strength despite their slim configuration; the contact surface also contributes to this.

Depending on the advancing task, the main teeth and/or the auxiliary teeth can be designed symmetrical or asymmetrical relative to a straight line extending through their tip and a center of the transporting roller.

The teeth can be provided as a straight tooth arrangement or a helical tooth arrangement on the transporting roller. For a straight tooth arrangement, the tractive power on the workpiece is better than in case of a helical tooth arrangement. The helical tooth rollers engage less abruptly the workpiece and effect additionally an axial force component so that the workpiece is subjected to a force transversely to the advancing direction and, in this way, can be reliably transported while being supported laterally on a longitudinal stop, for example.

It is possible that each main tooth of a tooth has correlated therewith not only one auxiliary tooth but, for example, also two or several auxiliary teeth, in particular when the transport roller has a great diameter. In this case, it is advantageous when the auxiliary teeth are stepped with regard to the tooth radius.

Further features of the invention result from the further claims, the description and drawings.

BRIEF DESCRIPTION OF THE DRAWINGS

The invention will be explained in the following with the aid of some embodiments illustrated in the drawings in more detail. It is shown in:

FIG. 1 in the schematic illustration a part of a transporting roller according to the invention whose teeth are partially in engagement with a workpiece;

FIG. 2 and

FIG. 3 each show a side view of a part of a further embodiment of a transporting roller according to the invention;

DESCRIPTION OF PREFERRED EMBODIMENTS

Figure 4:
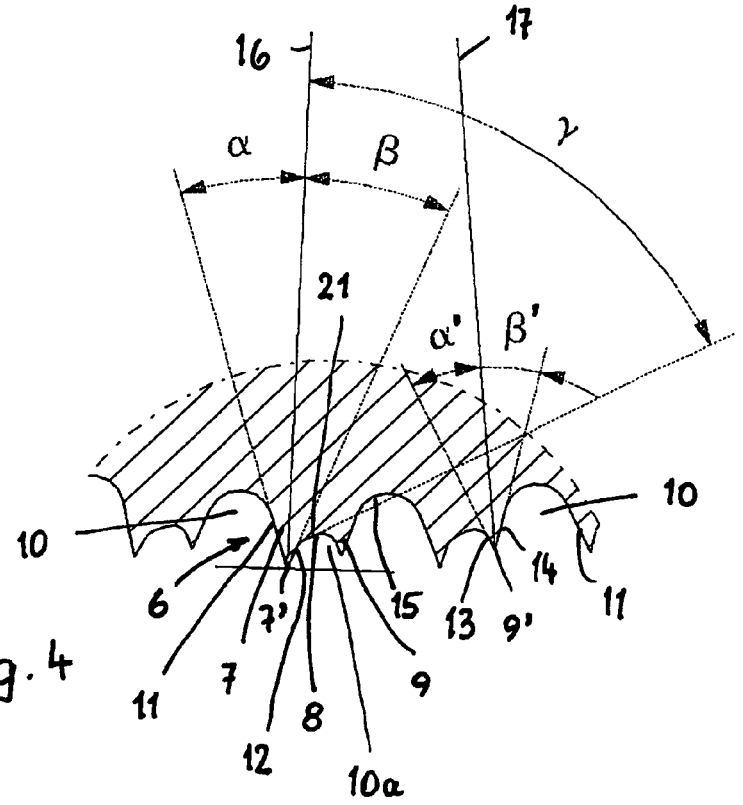
FIG. 4 in detail illustration a part of a further embodiment of a transporting roller according to the invention.

The transporting rollers serve for transporting pieces of wood, plastic and the like on a support, preferably on a support table, in order to feed them, for example, to tools with which the pieces of wood are machined.

FIG. 1 shows a transporting roller 1 with which workpieces 2 are transported on a support 3 such as a table in the advancing direction 5 wherein the transporting roller 1 is rotatably driven in the direction of arrow P. In the illustrated embodiment, the transport of the workpiece 2 is assisted on the workpiece bottom additionally by a table roller 4 which projects slightly past the support 3 and, as is known in the art, is pushed, preferably by a spring force, against the bottom of the workpiece 2. The table roller 4 is rotatably supported about a horizontal axis and can either be an idle roller or can be driven. The transporting roller 1, the support 3 and the table roller 4 can be, for example, parts of a moulder with which workpieces 2 are machined on four sides in a continuous process. Moulder is a term of the art for a milling machine for four-sided woodworking and is known as such and therefore will be explained in the following only briefly. Such a moulder has a bottom tool in a similar arrangement and in the same axial position as the table roller 4; this bottom tool first planes the workpiece 2 on the bottom side. In the advancing direction 5 downstream of the table roller 4 there are further tools on at least one right vertical spindle and at least one left vertical spindle. With these tools, the longitudinal sides of the workpiece 2, to the right and to the left in the advancing direction 5, are machined. These vertical spindles are positioned in the advancing direction 5 at a spacing behind each other. Subsequently, at least one top tool is provided that is driven about a horizontal axis in rotation and with which the topside of the workpiece 2 is machined. During advancing of the workpiece 2 through the moulder, the workpiece 2 is resting against a longitudinal stop along which the workpieces are transported by means of the transport rollers 1 through the moulder.

The transporting roller 1 is provided on its circumference with teeth 6 for improved transmission of the drive forces onto the workpiece 2. By means of the teeth, high advancing forces between the transporting roller 1 and the workpiece 2 are generated. For generating the advancing force, the teeth 6 are provided with a main tooth 7, a contact surface 8, and an auxiliary tooth 9. The main tooth 7 and the auxiliary tooth 9 each end at a tip 7', 9'. The tip 7' is positioned on a radius r1. The tip 9' of the auxiliary tooth 9 is positioned on a radius r2 (FIG. 1). The radius r1 is greater than the radius r2. The contact surface 8 is positioned on a significantly smaller radius ra. It is smaller than the radii r1, r2.

Depending on the roller pressure of the transporting roller 1, the teeth 6 penetrate with their main teeth 7 and auxiliary teeth 9 into the workpiece 2. The maximum penetration depth is reached when the contact surface 8 positioned between the main tooth 7 and the auxiliary tooth 9 reaches the topside of the workpiece 2.

The main tooth 7 is positioned in the rotational direction of the transporting roller 1 or in the advancing direction 5 upstream of the contact surface 8 which, in turn, is positioned upstream of the auxiliary tooth 9.

The main tooth 7 is delimited by two flat lateral surfaces 11, 12 which intercept each other at the tip T. The lateral surface 11 of the main tooth 7 forms a sidewall of a chip receiving space 10. These chip receiving spaces 10 are provided between neighboring teeth 6. The other lateral surface 12 of the main tooth 7 is shorter than the lateral surface 11 and passes with a rounded portion into the contact surface 8.

The auxiliary tooth 9 has two lateral surfaces 13, 14 that are advantageously flat and converge at the tip 9. The lateral surface 13 passes in a rounded shape into the contact surface 8. The significantly longer lateral surface 14 delimits the chip receiving space 10. The lateral surfaces 12 of the main tooth 7 and the lateral surface 13 of the auxiliary tooth 9 delimit the chip receiving space 10*a* that is smaller than the chip receiving space 10.

Since the transition from the lateral surface 12 of the main teeth 7 and the lateral surface 13 of the auxiliary teeth 9 into the contact surfaces 8 is configured as a rounded portion (a radius), sharp edges are avoided. This has the advantage that material and resin residues in the area of the teeth 6 are avoided. When in use of the transporting roller 1 adhering particles or residues are generated in spite of this configuration, such residues can be easily removed by cleaning brushes, scrapers or the like from the intermediate spaces between the main teeth 7 and the auxiliary teeth 9.

The chip receiving spaces 10 between neighboring teeth 6 are significantly greater than the chip receiving spaces 10*a* between the main teeth 7 and the auxiliary teeth 9 of the teeth 6. In this way, the chip receiving spaces 10 can accommodate chips that may be produced upon penetration of the teeth 6 into the workpiece 2. The transition from the lateral surfaces 11, 14 delimiting the chip receiving spaces 10 into the bottom 15 is advantageously also rounded.

In use, the teeth 6 engage the workpiece 2 with the main teeth 7 and the auxiliary teeth 9. With the auxiliary teeth 9 that are recessed with respect to the diameter of the transporting roller 1 an additional force transmission onto the workpiece 2 is achieved. The recessed auxiliary teeth 9 limit the penetration depth of the teeth 6 of the transporting roller 1. When the transporting roller 1 is new or the roller pressure is minimal, then only the main teeth 7 of the teeth 6 that are projecting with respect to the diameter of the roller penetrate into the workpiece 2. The recessed auxiliary teeth 9 do not penetrate, or penetrate only minimally, into the workpiece 2 when the transporting roller 1 is new or when an appropriately minimal roller pressure of the transporting roller 1 is applied. When the roller pressure of the transporting roller 1 onto the workpiece 2 is higher, the recessed auxiliary teeth 9 also penetrate into the workpiece 2. The contact surfaces 8 limit the penetration depth of the teeth 6. Preferably, the main teeth 7 and the recessed auxiliary teeth 9 are formed with the same wedge angle. The recessed auxiliary teeth 9 however can also be configured to be slimmer than the main teeth 7 because they are mechanically less strongly loaded than the main teeth 7. In this way, for the recessed auxiliary teeth 9 a smaller wedge angle can be provided; this means that the lateral surfaces 13, 14 delimiting the auxiliary tooth 9 can have a smaller angle relative to each other than the lateral surfaces 11, 12 of the main tooth 7. The area of the tooth 6 that contains the contact surface 8 is utilized in order to provide therein the auxiliary tooth 9. The contact surface 8 is positioned in the illustrated embodiment perpendicularly to a straight line that is extending through the tip of the main tooth 7 and the center of the transporting roller, i.e., it is approximately tangential. However, it is also possible to provide the contact surface 8 at an angle that deviates from a 90 degree angle relative to the straight line (FIG. 4). In this case, the teeth 6 can penetrate more deeply into the workpiece 2. When the workpiece is a soft wood or wood that is wet, the teeth will penetrate at little pressure, in comparison to hard wood, because of the higher elasticity of these pieces of wood.

With increasing wear of the main teeth 7 the recessed auxiliary teeth 9 are always in contact with the workpiece 2. The smaller auxiliary teeth 9 continue to penetrate into the workpiece 2 even when the main teeth 7 as a result of wear are rounded to such an extent that they can no longer engage the workpiece but simply form a depression in the surface of the workpiece. In this way, the service life of the transporting roller is significantly increased.

In the embodiment according to FIG. 2, each tooth 6 has a main tooth 7 and two auxiliary teeth 9 positioned at a spacing adjacent thereto. The auxiliary teeth 9 are recessed in accordance with the embodiment of FIG. 1 with regard to the diameter relative to the main tooth 7. The tips 9' of the two auxiliary teeth 9 can be at the same diameter. However, it is also possible that the two auxiliary teeth 9 project differently far with their tips 9'.

The main tooth 7 as well as the auxiliary tooth 9 that is downstream in the rotational direction of the transporting roller 1 are of the same configuration as in the preceding embodiment. The lateral surface 14 of the neighboring auxiliary tooth 9 that is facing away from the main tooth 7 passes in a rounded shape into a second contact surface 8' that is advantageously narrower in the circumferential direction of the transporting roller 1 than the contact surface 8 positioned between the main tooth 7 and the neighboring auxiliary tooth 9. The contact surface 8' passes with a rounded shape into the lateral surface 13' of the downstream auxiliary tooth 9. The other lateral surface 14' of the second auxiliary tooth 9 forms one sidewall of the chip receiving space 10.

The auxiliary teeth 9, as described in the preceding embodiment, can be slimmer than the main tooth 7 of the tooth 6. The second auxiliary tooth 9 that is positioned adjacent to the chip receiving space 10 can also be slimmer than the auxiliary tooth 9 positioned adjacent to it. The action of the transporting roller 1 is in other respects the same as in the preceding embodiment of FIG. 1. Each tooth 6 has two chip receiving spaces 10*a*, 10*b*, that are positioned between the main tooth 7 and the two auxiliary teeth 9 and are smaller than the chip receiving spaces 10.

In the embodiment according to FIG. 3, each tooth 6 of the transporting roller 1 also has the main tooth 7 and two auxiliary teeth 9 that are positioned upstream and downstream of the main tooth 7. In the embodiment according to FIG. 2, the teeth 6 are arranged such that in the circumferential direction the main and auxiliary teeth of the teeth 6 are arranged identically so that between the main teeth 7 of neighboring teeth 6 two auxiliary teeth 9 are positioned. In the embodiment according to FIG. 3 two auxiliary teeth 9 are mirror symmetrically arranged relative to the main tooth 7 so that in the circumferential direction of the transporting roller 1 between neighboring main teeth 7 four auxiliary teeth 9 are positioned wherein the auxiliary teeth 9 of one tooth 6 are separated by the chip receiving space 10 from the auxiliary teeth 9 of the neighboring tooth 6. The auxiliary tooth 9 adjacent to the main tooth 7 has a greater radius than the following auxiliary tooth 9 of the same tooth 6.

Such an arrangement is preferably used in connection with transporting rollers that are very large with regard to their diameter and have a correspondingly great circular pitch. As a result of this configuration of the teeth 6, a stronger advancing force is generated because a greater number of teeth 7, 9 are in contact with the workpiece 2. It is also possible to provide only one auxiliary tooth 9 symmetrically upstream and downstream of each main tooth 7.

FIG. 4 shows a tooth configuration in accordance with FIG. 1. The tooth 6 has the main tooth 7 which is connected by means of the contact surface 8 with the auxiliary tooth 9. The main tooth 7 has the wedge angle $\alpha+\beta$. It is preferably smaller than approximately 50 degrees. Relative to the straight line 16 that extends through its tip 7 and the center of the transporting roller 1 and that is perpendicular to the correlated tangent, the main tooth 7 has an asymmetric cross-sectional shape. The lateral surface 11 of the main tooth 7 facing away from the auxiliary tooth 9 is positioned relative to the straight line 16 at an angle $\alpha$. The other lateral surface 12 of the main tooth 7 is positioned relative to the straight line 16 at an angle $\beta$ which in the embodiment is greater than the angle $\alpha$.

Relative to the straight line 17 that is extending through tip 9' and perpendicular to the correlated tangent, the auxiliary tooth 9 is also asymmetrically configured in cross-section. The lateral surface 13 of the auxiliary tooth 9 facing the main tooth 7 is positioned relative to this straight line 17 at an angle $\alpha'$ which, in the illustrated embodiment, is smaller than the angle $\beta'$ that is defined between the lateral surface 14 of the auxiliary tooth 9 and the straight line 17.

It is also possible that both angles $\alpha$, $\beta$ have the same size. It is also possible that the angle $\alpha$ has a negative value.

The contact surface 8 that is positioned between the main and auxiliary teeth 7, 9 of the teeth 6 is positioned at an angle $\gamma$ that is smaller than 90 degrees relative to the straight line 16 of the corresponding main tooth 7. With this slanted contact surface 8 it is prevented that the teeth 6 penetrate too deeply into the workpiece 2. Should there be chips of the workpiece 2 already contained in the chip receiving spaces 10*a* between the main tooth 7 and the auxiliary tooth 9, these chips and/or other adhering particles or residues are forced by the slanted contact surface 8 in the direction of the recessed tooth and upon each rotation of the transporting roller 1 are severed. In order to facilitate this severing effect, it is advantageous to provide the transition from the contact surface 8 to the lateral surface of the main tooth 7 and the lateral surface 13 of the auxiliary tooth 9 with rounded portions or with a radius.

The bottom 8 of the chip receiving space 10*a* of the tooth 6 has the flat bottom section 21 that adjoins at an obtuse angle the corresponding lateral surface 12 of the main tooth 7 and passes with a radius into the lateral surface 12 of the main tooth 7 and into the lateral surface 13 of the auxiliary tooth 9. The bottom 15 of the chip receiving space 10 between the neighboring teeth 6 is formed completely by the radius between the lateral surfaces 11, 14. In this way, relatively large chip receiving spaces 10 are formed. In combination with the concave continuously curved bottom 15 of the chip receiving space 10, it is ensured that chips contained in the chip receiving space can be quickly removed.

Figure 5:
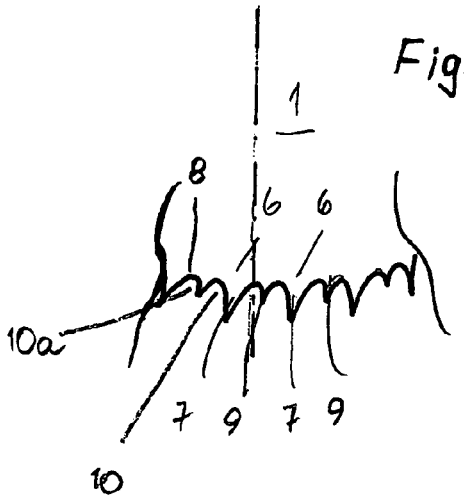
FIG. 5.

FIG. 5 shows in schematic illustration and in an exemplary fashion a transporting roller 1 in which each tooth 6 is provided with the main tooth 7 and the auxiliary tooth 9. Between neighboring teeth 6 the chip receiving spaces 10 are provided. Between main tooth 7 and auxiliary tooth 9 of each tooth 6 the chip receiving space 10*a* is provided. The chip receiving spaces 10, 10*a* have approximately the same depth. In other respects, the teeth 6 can be of the same configuration as in the embodiments of FIGS. 1 to 4. Instead of the straight or flat contact surfaces, rounded contact surfaces 8 are provided so that rounded tooth shapes result.

Figure 6:
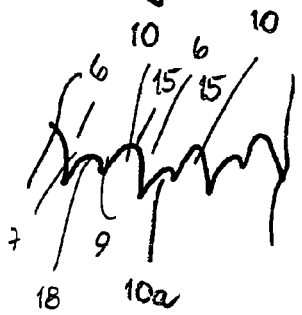
FIG. 6 further embodiments of a transporting roller according to the invention.

FIG. 6 shows schematically an embodiment similar to FIG. 5. The chip receiving spaces 10*a* between the main teeth 7 and the auxiliary teeth 9 of each tooth 6 are less deep than the chip receiving spaces 10 between neighboring teeth 6. The bottom 15 of the chip receiving spaces 10 is designed to be concavely rounded. Also, the chip receiving spaces 10*a* between the main teeth 7 and the auxiliary teeth 9 of each tooth 6 have a concavely rounded surface 18. The teeth 6 with the main teeth 7 and the auxiliary teeth 9 can be configured in accordance with the embodiments of FIGS. 1 to 4.

The rounded bottom 15 of the chip receiving spaces 10 improves cleaning of the transporting roller 1 from chips contained within the chip receiving spaces 10 or from adhering particles and residues. Because there is no longer a distinct contact surface 8, the transporting roller 1 can also advantageously be used for transporting wet wood because higher advancing forces are required for advancing since the wood will essentially get stuck by suction on the contact surface due to moisture. Accordingly, the friction value relative to the support in case of wet wood is significantly higher than in case of dry wood.

Figure 7:
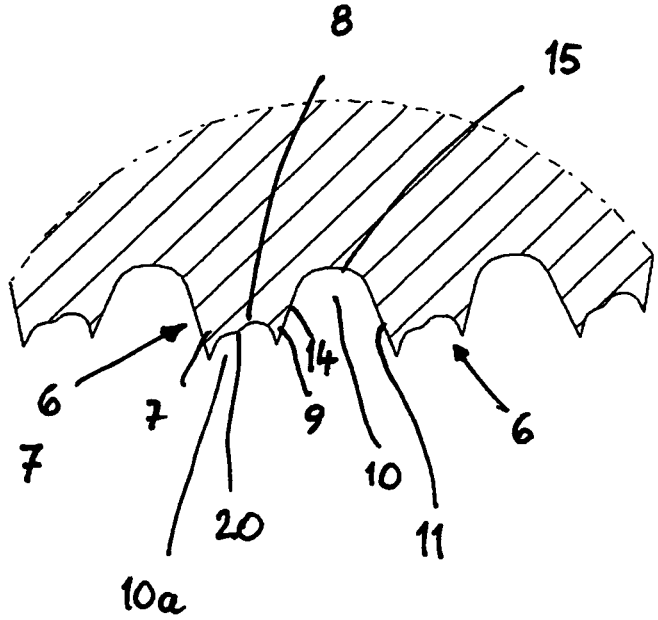
FIG. 7.

In the transporting roller according to FIG. 7, the contact surface 8 between the main tooth 7 and the auxiliary tooth 9 of the each tooth 6 is provided with a slight raised portion 20 so that a small rounded ledge is formed. This raised portion 20 with the ledge has the advantage that chips that are possibly contained in the chip receiving space 10*a* will be reliably stripped off and simply conveyed away upon engagement of the rotating transporting roller in the workpiece.

As already disclosed in connection with the preceding embodiments, the chip receiving space 10*a* of each tooth 6 is smaller than the chip receiving space 10 between neighboring teeth 6. The contact surface 8 is positioned, similar to the embodiment according to FIG. 4, in such a slanted arrangement that it has at the transition to the main tooth 7 a greater spacing from the axis of rotation of the transporting roller than at the transition to the auxiliary tooth 9.

The bottom 15 of the chip receiving space 10 passes at a great radius into the lateral surfaces 11, 14 which facilitates removal of chips that are contained in the chip receiving space 10.

Figure 8:
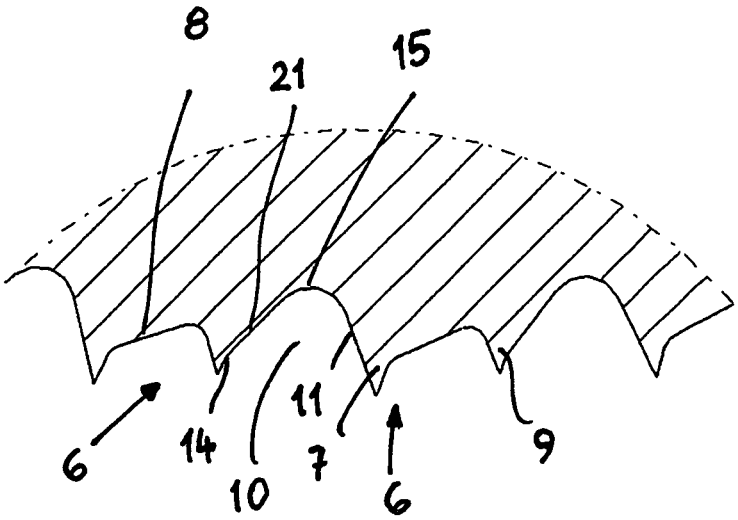
FIG. 8 in detail illustration further embodiments of a transporting roller according to the invention.

In the embodiment according to FIG. 8, the contact surface 8 between the main tooth 7 and the auxiliary tooth 9 of the tooth 6 are of a flat configuration and passes tangentially constant at a radius into the corresponding lateral flanks of the main tooth 7 and the auxiliary tooth 9. The contact surface 8 is also arranged at a slant such that at the transition to the main tooth 7 it has a greater radial spacing from the axis of rotation of the transporting roller than at the transition to the auxiliary tooth 9.

The bottom 15 of the chip receiving space 10 between neighboring teeth 6 has also a flat section 21 that adjoins at an obtuse angle the lateral surface 14 of the auxiliary tooth 9. The bottom section 21 passes at a great radius continuously curved into the lateral surface 11 of the main tooth 7. With this configuration, the lateral surface 14 of the auxiliary tooth 9 becomes very short and no wedge-shaped chip receiving spaces in which chips could become clamped are provided between the main teeth 7 and the auxiliary teeth 9 of neighboring teeth 6.

Figure 9:
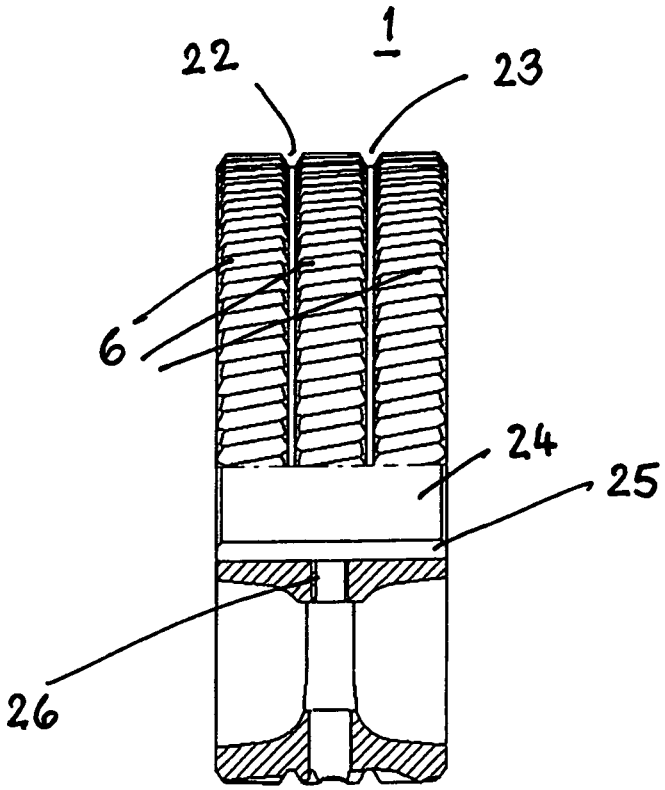
FIG. 9 a view of the transporting roller according to FIG. 8 in half-section viewed opposite to the advancing direction.

The teeth 6 are arranged in distribution about the circumference of the transporting roller 1 and extend advantageously across the width of the transporting roller 1. The teeth 6 can be arranged across the width of the transporting roller 1 also in several rows that are separated from each other by circumferential grooves (FIG. 9).

The transporting roller 1 has, for example, two circumferential grooves 22, 23 that are positioned at a spacing to each other. The tooth rows are advantageously of the same width. The transporting roller 1 has, as is known in the art, a central through opening 24 and is fixedly attached to a shaft (not shown). The fixed connection is realized, for example, by a parallel key/parallel keyway connection wherein the parallel keyway 25 is illustrated in FIG. 9.

In order to prevent axial sliding of the transporting roller 1 on the shaft, a radial threaded bore 26 opens into the through opening 24 and receives a screw (not illustrated) therein with which the transporting roller 1 is secured against axial sliding on the shaft.

In deviation from the illustrated embodiment, it is also possible to flange-connect the transporting roller 1 on the shaft.

In the described embodiment, a very high advancing force transmission onto the workpiece 2 is possible so that the workpieces, even when they are wet, can be reliably transported on the support surface. The recessed auxiliary teeth 9 of the teeth 6 contribute significantly to this effect. The described self-cleaning effect of the transporting roller 1 ensures that the grip of the transporting roller 1 is ensured also under severe conditions, for example, when transporting wet wood. The chips that are contained in the chip receiving spaces 10, 10*a* are forced away or stripped off every time the teeth 6 are penetrating into the workpiece 2. When the bottom 15, 18 of the chip receiving spaces 10, 10*a* are rounded as in the embodiment according to FIG. 6, the chips are forced out by these rounded portions. This self-cleaning effect can be improved in that the bottom 15, 18 of the chip receiving spaces 10, 10*a* are not uniformly rounded but non-uniformly rounded.

At least the teeth 6 of the transporting roller 1 can be surface-hardened so that the wear resistance is increased. The surfaces can be, for example, chrome-plated or provided with a wear-resistant layer by thermal spray coating.

The main teeth 7 and the auxiliary teeth 9 can have different wedge angles in order to prevent these teeth from penetrating too far into the workpieces 2. The greater the wedge angle, the smaller the penetration depth of each tooth into the workpiece. The transporting roller can advantageously be used also for hardwood because in particular in this context an extremely low penetration of the teeth into the wood is desired so that only minimal wood must be removed from the workpiece topside.

Since each tooth 6 is provided with at least one auxiliary tooth 9, even for a completely worn main tooth 7 an excellent advancing action on the workpiece 2 will result. With increasing wear of the teeth 6 the shape of the transporting roller 1 approximates the shape of a knurled roller. Accordingly, the worn transporting roller still has a sufficient advancing force that is significantly higher than that of conventional transporting rollers at a comparable state of wear. In a conventional transporting roller, the roller shape resembles more and more that of a cylinder with increasing tooth wear so that the advancing action deteriorates significantly.

The auxiliary teeth 9, with regard to obtaining higher advancing values, can have shapes that are different from those of the corresponding main teeth 7 of the teeth 6. For example, the lateral walls 13, 14; 13', 14' of the auxiliary teeth 9 can be embodied to be steep (small wedge angle) because the bending load on the tooth base as a result of the short length of the auxiliary teeth 9 is minimal.

The highest service life and an excellent transmissible advancing force are achieved when the contact surfaces 8, 8' in the described way are arranged to be recessed deeper. The transition from the lateral surfaces of the main and auxiliary teeth 7, 9 to the contact surfaces 8, 8' is rounded as described so that the transporting roller has the described self-cleaning effect and the main and auxiliary teeth 7, 9 have an optimal strength. When a deep penetration of the teeth into the workpiece 2 is desired, the contact surface 8, 8' is provided appropriately farther recessed (is deeper) relative to the circumference of the transporting roller 1.

The transporting rollers 1, depending on the configuration of the main and auxiliary teeth 7, 9 can be used for a wide range of applications. For example, the transporting roller 1 with regard to the shape of these teeth can be optimally matched to various material properties.

Depending on the application profile, the ratio of the radii r1 and r2, the radial length of the main teeth 7 and of the auxiliary teeth 9, the wedge angle of the teeth 7, 9, the angle of the ascending and descending flanks of the main and auxiliary teeth 7, 9 relative to the straight line 16 can be varied. Also, the diameter of the transport roller and the tooth pitch, i.e., the number of teeth 6 arranged about the circumference, can be varied. The different arrangements of main and auxiliary teeth disclosed in the Figures with the chip receiving spaces positioned between them are not limited to these embodiments but further arrangements of main teeth and recessed auxiliary teeth can be found.

By combining the described variants, a plurality of possibilities for the configuration of the transporting roller 1 are available.

Figure 10:
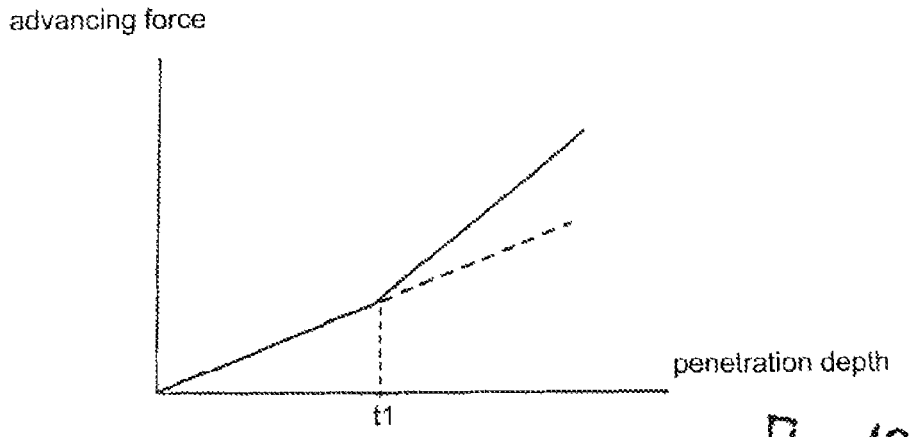
FIG. 10 in a diagram the dependency of the transmitted advancing force on the penetration depth of the transporting roller according to the invention.

FIG. 10 shows in a diagram schematically the effect of the main teeth 7 and the auxiliary teeth 9 of the transporting roller 1. In this diagram the advancing force is illustrated relative to the penetration depth of the teeth. First only the main teeth 7 penetrate into the workpiece 2. With increasing penetration depth the advancing force increases also. When the main teeth 7 have reached an appropriate penetration depth, the auxiliary teeth 9 become effective. At the point t1, the main teeth 7 have penetrated so far into the workpiece 2 that also the auxiliary teeth 9 are in engagement with the workpiece 2. With the additional engagement of the auxiliary teeth 9 the advancing force is significantly increased.

Figure 11:
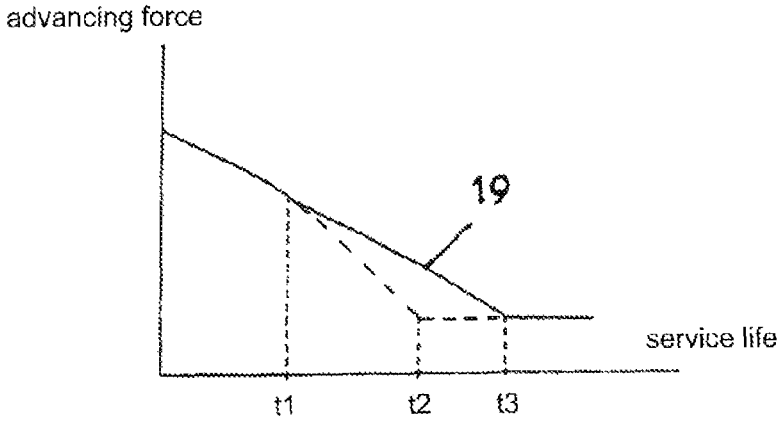
FIG. 11 in a diagram the dependency of the transmitted advancing force on the service life of the transporting roller according to the invention.

Because of the auxiliary teeth 9 the service life of the transporting roller 1 is extended. In FIG. 11, the advancing force of the transporting roller 1 as a function of the duration of use or service life is illustrated. With increasing duration of use of the transporting roller 1 the advancing force decreases. The curved section that is illustrated in dashed lines indicates the course of the service life when the transporting roller 1 is provided only with the main teeth 7. At the point t2, the teeth are worn so much that they no longer engage the workpiece 2 and the advancing force results only from friction of the remaining cylindrical wall surface. At this point in time the actual limit of the service life is reached. Since the transporting roller 1 however has auxiliary teeth 9, the advancing force increases with increasing duration of use of the transporting roller 1, as indicated by the curve section 19. At the point in time t3 the main teeth 7 and the auxiliary teeth 9 are completely worn. The advancing force has reached its lowest value and the limit of the service life is reached; however this happens at a point in time much later in comparison to a conventional roller. At the point in time t1, the main teeth 7 are worn to such an extent that the auxiliary teeth 9 are always in contact with the workpiece 2. At this point in time, the advancing force, as indicated by the curve section 19, decreases less in comparison to a transporting roller 1 provided only with the main teeth 7.

The relative increase of the advancing force in accordance with the curve section 19 is based on the fact that the sharp auxiliary teeth 9 that are not yet worn much penetrate into the workpiece 2 and enlarge the engagement surfaces which leads to a significant extension of the advancing action.

What is claimed is:

1. A transporting roller for advancing workpieces of wood or plastic, the transporting roller comprising teeth arranged in distribution about a circumference of the transporting roller, wherein at least some of the teeth comprise a main tooth and at least one auxiliary tooth that is positioned in a circumferential direction of the transporting roller at a spacing relative to the main tooth, wherein when viewed in a normal section plane relative to an axis of rotation of the transporting roller, the at least one auxiliary tooth has a tooth tip radius, measured relative to an axis of rotation of the transporting roller, that is smaller than a tooth tip radius of the main tooth, measured relative to the axis of rotation of the transporting roller; and wherein the main tooth and the at least one auxiliary tooth are connected to each other by a contact surface, the contact surface extending in a circumferential direction between the main tooth and the auxiliary tooth.

2. The transporting roller according to claim 1, wherein the at least one auxiliary tooth is arranged downstream of the main tooth in a rotational direction of the transporting roller.

3. The transporting roller according to claim 1, wherein the at least one auxiliary tooth is arranged upstream of the main tooth in a rotational direction of the transporting roller.

4. The transporting roller according to claim 1, wherein the contact surface adjoins transversely a lateral surface of the main tooth and a lateral surface of the at least one auxiliary tooth.

5. The transporting roller according to claim 1, wherein the lateral surface of the main tooth and the lateral surface of the at least one auxiliary tooth pass with a rounded portion into the contact surface.

6. The transporting roller according to claim 1, wherein the lateral surface of the main tooth or the lateral surface of the at least one auxiliary tooth pass with a rounded portion into the contact surface.

7. The transporting roller according to claim 1, wherein the contact surface forms a bottom of a chip receiving space.

8. The transporting roller according to claim 7, wherein the contact surface has a raised portion.

9. The transporting roller according to claim 1, wherein the main tooth and the at least one auxiliary tooth have dissimilar profile cross-sections.

10. The transporting roller according to claim 1, wherein the main tooth has a first wedge angle and the at least one auxiliary tooth has a second wedge angle, wherein the first wedge angle is greater than the second wedge angle.

11. The transporting roller according to claim 1, wherein the main tooth has a first wedge angle and the at least one auxiliary tooth has a second wedge angle, wherein the first wedge angle and the second wedge angle are identical.

* * * * *